United States Patent [19]

Andruszkiewicz

[11] 4,012,868

[45] Mar. 22, 1977

[54] PREHUNG DOOR ASSEMBLY

[76] Inventor: Julian Andruszkiewicz, 540 Hawthorne, Elmhurst, Ill. 60126

[22] Filed: Feb. 13, 1975

[21] Appl. No.: 549,508

[52] U.S. Cl. ..... 49/380; 49/505; 52/212; 16/135

[51] Int. Cl.[2] ..... E06B 1/10

[58] Field of Search ..... 49/380, 501, 504, 505, 49/399, 400, 480, 483; 52/211, 212, 213, 217; 16/128, 135

[56] References Cited

UNITED STATES PATENTS

| | | | |
|---|---|---|---|
| 403,572 | 5/1889 | Boda | 49/400 |
| 1,821,606 | 9/1931 | Anderson | 16/135 X |
| 2,678,463 | 5/1954 | Westphal | 16/135 X |
| 2,913,777 | 11/1959 | Viets | 49/505 |
| 3,614,846 | 10/1971 | Donnelly et al. | 52/213 |

*Primary Examiner*—Kenneth Downey
*Attorney, Agent, or Firm*—Dominik, Knechtel, Godula & Demeur

[57] ABSTRACT

A split jamb prehung door assembly wherein a door is connected to a side jamb part by a split hinge assembly in which one plate has multiplanar parts, one part mounted to the side jamb and another part extending normally to the side jamb part against a door casing. Sizing clips are further mounted on the spaced side jambs, and such clips have rearwardly extending arms which are deformable so that they can be moved and fastened to the adjoining wall studs of a doorway opening, such sizing clips further mounting the door casing to the jambs so that preformed apertures in the normally extending plate and clip parts are registered with preformed openings in the casing to allow fasteners to be passed through the registered openings and into the adjoining wall studs. A mating jamb and casing member is then moved into the doorway to interlock the mounted door jamb sides and connect a top jamb part.

11 Claims, 5 Drawing Figures

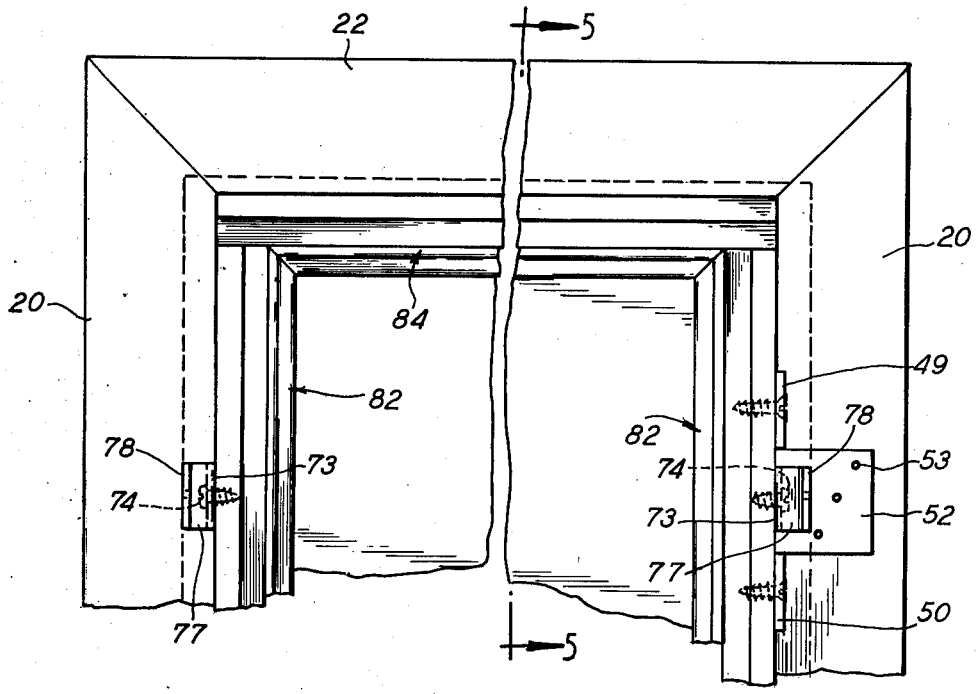
Fig. 4
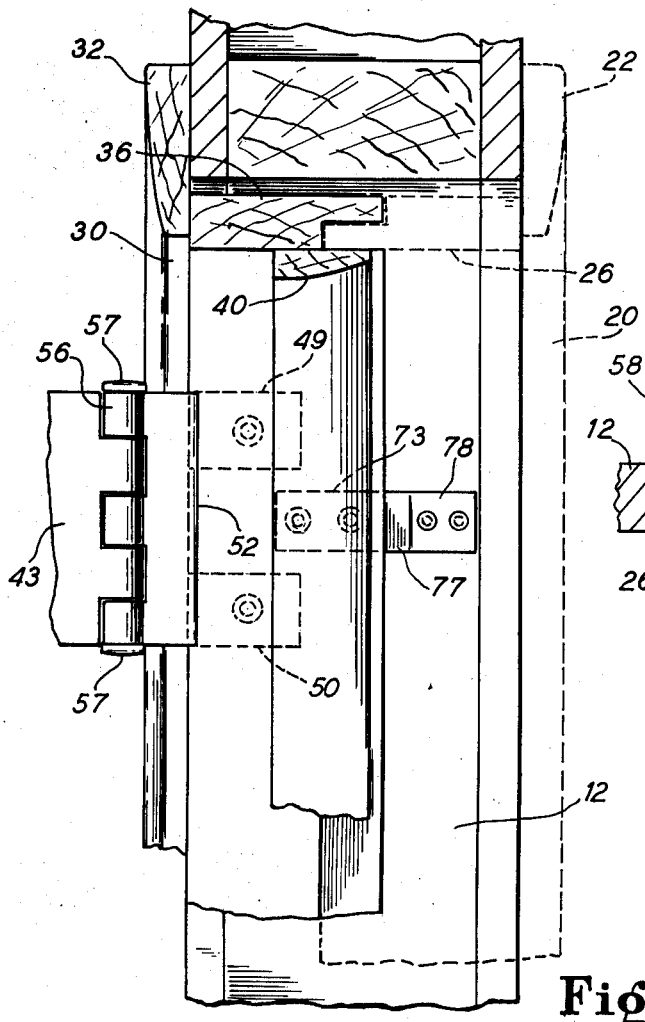
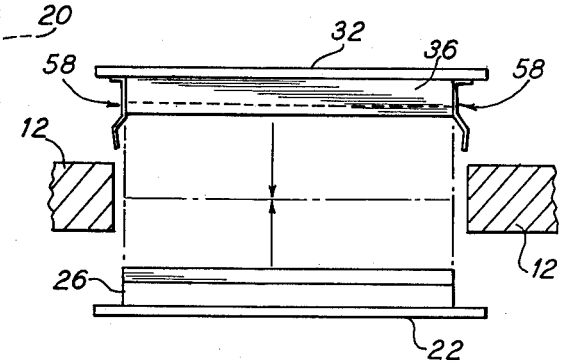
Fig. 3
Fig. 5

PREHUNG DOOR ASSEMBLY

This invention relates to an improved prehung door assembly of the split jamb type wherein a door mounted jamb part positioned in one opening of a doorway is mated with a matching jamb member mounted from the opposite opening of the doorway. The invention also relates to an improved method of mounting such a prehung door assembly in the doorway opening.

Prehung split door jamb assemblies are commonly used in construction projects. The split jamb door assemblies are a distinct departure from the unitary jamb prehung door assemblies in which unitary jamb parts, having spaced side jambs and a connecting top jamb, are mounted in a doorway opening with the door hinged to one of the side jamb parts. The split jamb approach provides dividing the unitary jamb along a plane which bisects the unitary jamb between its opposite openings. The two jamb parts are then provided with interlocking means such as laps so that a lap or a rabbet joint is formed when the two jamb members are moved towards each other from opposite openings of the doorway. In the usual practice, the door is hinged to a side jamb of one of the mating jamb members.

The joint may be secured with adhesive or fasteners, and it is generally covered with a molding or casing strip. The doorway is always oversized relative to the spacing between the mated jamb parts to assure entry of the prehung door assembly in the doorway opening. The spacing between the wall studs of the doorway opening and the mated jamb parts must then be bridged and secured; and this is usually performed by inserting wooden shim members into the gaps. Finishing steps for the prehung door assembly then require mounting a door casing adjoining the hinged door at one opening, and a doorway casing at the opposite door opening. Such various steps of securing fastening, shimming, and finishing are time consuming and require shimming materials.

It is an object of the present invention to provide an improved prehung split jamb door assembly which can be more quickly mounted with fewer steps and with a saving of shimming materials which are not needed for successful mounting.

Another object is to provide an improved prehung door assembly of the split jamb type wherein a door is premounted to a side jamb member by improved means which allow the worker to mount the assembled door and jamb in a doorway opening, and then to securely fix the casing and attached door and jamb to the wall stud by the simple expedient of mounting a few fasteners. A further feature of this object also allows the worker to secure the spaced side jambs to the adjoining wall studs of the doorway opening by the simple expedient of mounting a few fasteners without requiring shimming or the like.

Yet still another object is to provide an improved prehung door assembly of the type described which permits improved premounting of doorway and door components to jamb parts to achieve further significant savings in labor and mounting procedures.

Yet another object is to provide the improved prehung door assembly of the type described by a combination of improved hinge and deformable sizing members which premount the major components of a split door assembly so that only simple process steps are required, namely, inserting one part in a doorway opening and securing and finishing said part by inserting a few fasteners; and thereafter inserting a mating part from the opposite door opening with a few fasteners.

Yet another object is to provide a method whereby a a prehung door assembly of the split jamb type can be mounted by fewer, time saving process steps through utilizing improved prefabricated components.

Such objects objects are now attained together with still other objects which will occur to practitioners from time to time upon consideration of the invention shown in the following disclosure which includes drawings wherein:

FIG. 3 is a top plan view, somewhat schematic and on a reduced scale, showing the step for mounting and joining the split jamb components;

FIG. 4 is a rear elevational view in portion with parts removed, of the door mounted casing and jamb components; and FIG. 5 is a view taken along line 5—5 of FIG. 4.

Figure 1:
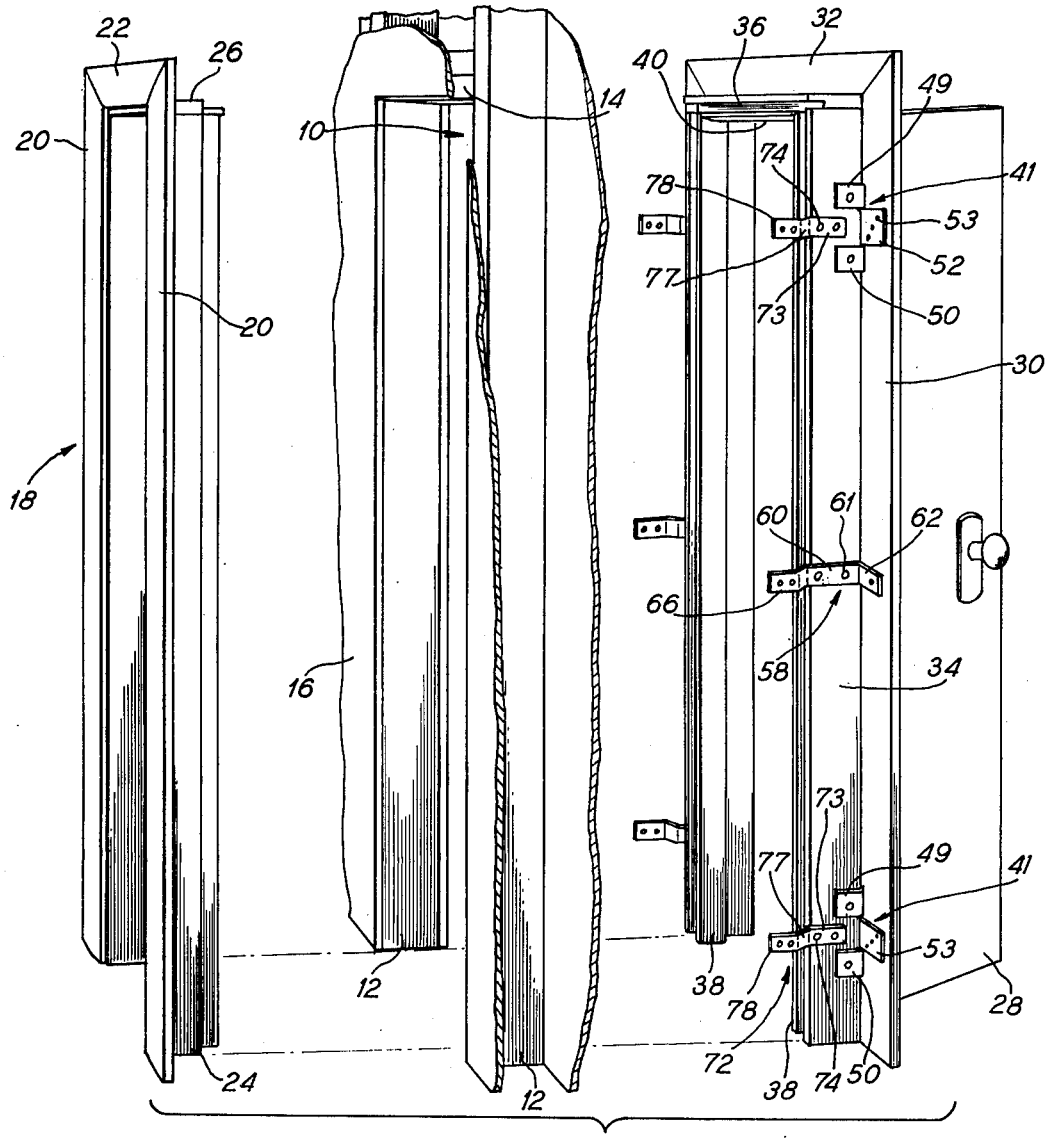
FIG. 1 is a an exploded perspective view showing split jamb door components for mounting in a doorway opening.

Referring to the drawings, the exploded view of FIG. 1 shows a door opening 10 in which the split or double jamb component door will be mounted. Such opening is formed by spaced side studs 12 as well as a connecting top wall stud 14. In the illustrated embodiment there is shown dry wall member 16 mounted to the wall studs, although, alternatively, lathe and plaster may be present.

In one side of the door opening 10 is mounted a casing and jamb component assembly shown generally as 18. The component 18 is actually mounted after the other door casing and jamb component is mounted in place, as will be later described. Component or member 18 includes spaced side casings 20 connected by a top casing 22. Such casings are mounted to side jamb 24 which are also connected by a stepped top jamb part 26. The jambs 24 are shown with an inside lap relative to the doorway opening 10 and the top jamb part is shown with a bottom lap relative to said door opening.

The prehung door assembly component is shown to the right of the doorway opening 10 in FIG. 1, and such assembly or component includes the door 28 and a door casing which has spaced side casings 30 and a connecting top casing 32. The jamb member has spaced side jamb parts 34 and a connecting top jamb part 36. The side jamb parts 34 have premounted side jamb casings 38 secured by nail fasteners 39. Also premounted is a top jamb casing 40 which can best be seen in the view of FIG. 5. The side jamb parts 34 have inside laps and the top jamb part 36 has an upper lap, all relative to doorway opening 10. The lap joint of the assemblied jamb components is seen in the sectional view of FIG. 2.

The door 28 is mounted to a side jamb part by a split hinge assembly shown generally as 21. A hinge pivot generally shown as 42 pivotally joins the door to the jamb and wall stud. A door plate 43 is secured by screw fastener 44 to the door edge, and such plate is connected to the hinged joint 42. A multiplanar split plate member 45 is also adjoined to the hinged pivot 42. Such split plate member includes a uniplanar portion 48 adjoining the hinge pivot 42 which is normal to immediately adjacent uniplanar portion 48. Jamb plate parts extend normally to the uniplanar portion 48, such parts being shown as upper jamb plate 49 and lower jamb plate 50, such terms being used relative to the top and bottom of door 28. The upper and lower jamb plate parts are secured to the adjoining side jamb 34 by screw fasteners 51. It is seen that the jamb plate parts 49, 50 are in fixed parallel relationship to uniplanar side 46 of the split plate member; and are further parallel to door plate member 43 when the split hinge assembly and the door are in closed position.

The split plate member is further shown as having a stud plate part 52 which is coplanar with uniplanar portion 48, and is normal relationship to upper and lower jamb plate parts 49, 50. The stud plate part 52 is shown as being intermediate the upper and lower jamb plate parts, and such stud plate part is provided with a plurality of mounting plate apertures 53. The mounting apertures in the plate are in registry with a mounting aperture 54 in door casing 30. A finishing nail fastener 55 passes through the aligned casing aperture 54 and stud plate mounting apeture 53 to be embedded in wall stud 12. The split hinge assembly is therefore fully mounted, and is then completely installed when the worker attaches the finishing nails 55 through the registered preformed stud plate aperture and casing passageway. The hinge pivot 42 of the split hinge assembly comprises the usual aligned hinge bearing collars integral with the door plate member 43 and the split member 45, such collars being collectively indicated by the numeral 56. A double head pintel 57 is shown passing through the aligned bearing collars.

The door jamb component is first mounted in the door opening 10 by securing deformable sizing clips, one of which is shown as prebent double arm sizing clip 58. Such clip includes a body portion 60 which is fastened to the outside of the side jamb by screw fasteners 61. One end of the body portion has a right angle arm 62 which contacts the jamb side of side casing 30. Arm 62 has a mounting aperture 63 which is aligned with a preformed casing passageway 64 so that the worker can insert a finishing nail fastener 65 through the registered or aligned passageway and aperture. Such nail fastener secures the casing 30 and dry wall 16 to the front of underlying stud 12, as well as further securing sizing clip 58.

The opposite end of the body portion 61 of the sizing clip 58 has an arm 66 which extends rearwardly of side jamb 34. The arm 66 is spaced away from body portion 61 towards the side of adjoining wall stud 12. The arm 66 has an incline portion 67 which connects parallel portion 68 to body portion 61, portion 68 being substantially parallel to the body 61. The door jamb component is positioned in the door opening 10, and then the arm 66 is displaced to contact the side of the adjoining wall stud. Nail fasteners 69 are passed through mounting aperture 70 in arm 66 to secure the sizing clip to the side of the wall stud 12.

A prebent single arm sizing clip 72 is provided for positioning between the upper and lower jamb plate part 49, 50. The single arm sizing clip has a body portion 73 which is secured by screw fastener 74 to the outside of the side jamb part 34. The single displacable arm 76 has a connecting incline portion 47 which joins the body portion 73 to parallel portion 78. Nail fasteners 79 pass through mounting apertures to secure the single arm sizing clip 72 to the side of the adjoining wall stud 12. Such nail fasteners passing through mounting apertures 80 in parallel portion 78.

Figure 2:
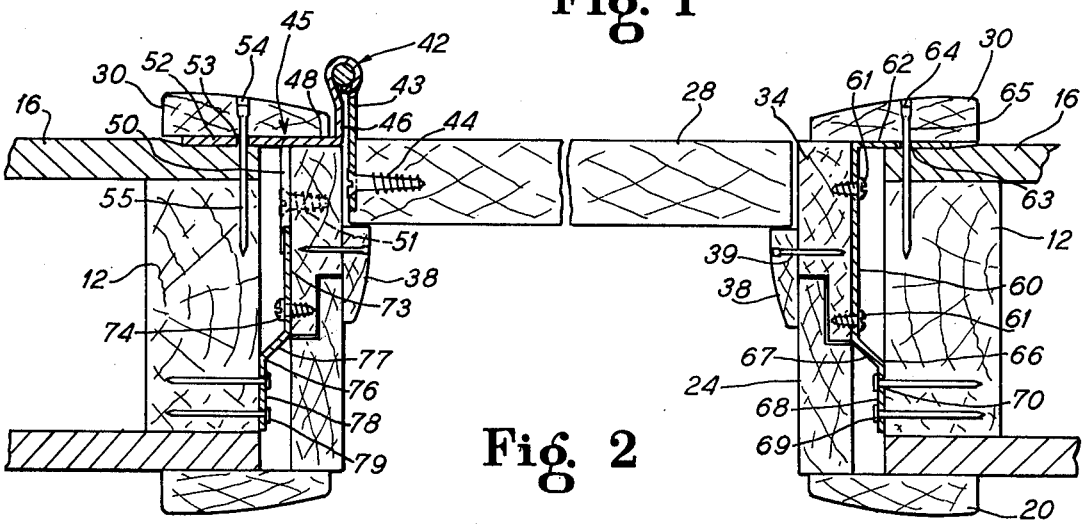
FIG. 2 is a sectional view, on an enlarged scale, through an assembled prehung door assembly of the split jamb type.

The assembled jamb component parts are seen in the sectional view of FIG. 2 and may also be seen generally at 82 in the view of FIG. 5. Such assembled side jamb parts form a lap or a rabbet joint, and a similar joint is formed from the assemblied top jambs at 84.

The claims of the invention are now presented and the terms of such claims may be further understood by the language of the preceding specification and the view of the drawings.

What is claimed is:

1. A split jamb door assembly for mounting in a door opening and for engaging matching split jambs, including spaced matching side jamb parts, a top jamb connecting the spaced side jamb parts, a door connected by a plurality of spaced split hinge assemblies to one of the side jamb parts, each split hinge assembly having a uniplanar plate member fastened to the door, said uniplanar plate member joined to a hinge pivot, and each split hinge assembly having a split plate member joined to said pivoted hinge, each split plate member having a stud plate part normal to the door fastened uniplanar plate member when said split hinge assembly is in closed position, said stud plate part having a plurality of mounting apertures for fastening the stud plate part to the front of a wall stud, and said split member further having an adjoining jamb plate part fastened to a side door jamb part and extending normally to said stud plate part.

2. A split jamb door assembly for mounting in a door opening which includes the features of claim 1 wherein said split plate member has a uniplanar portion adjoining said hinge pivot, said stud plate being coplanar with said uniplanar portion, and said jamb plate part being prebent normally to said coplanar stud plate part and said uniplanar portion.

3. A split jamb door assembly for mounting in a door opening which includes the features of claim 2 wherein said split plate member includes coplanar upper and lower stud plate parts spaced from each other, and said jamb plate part extending normally intermediate said spaced stud plate parts.

4. A split jamb door assembly for mounting in a door opening which includes the features of claim 3 above wherein said split plate member has a uniplanar side adjoined to said hinge pivot and being parallel to said jamb plate parts, and the uniplanar portion adjoining said uniplanar side, said uniplanar portion being coplanar with said intermediate stud plate part.

5. A split jamb door assembly for mounting in a door opening which includes the features of Claim 3 and which further includes a plurality of sizing clips mounted to the outsides of both spaced side jambs for contact with spaced doorway opening studs, such sizing clips including a body portion fastened to the side jambs, a substantially parallel arm portion spaced away from the side jambs, and an incline portion connecting said arm and body portions, whereby said arm is selectively displaced to contact the sides of the opposite doorway studs for fastening thereto.

6. A split jamb door assembly for mounting in a door opening which includes the features of claim 5 wherein said sizing clip includes a second arm extending substantially normal to said body portion at the end opposite to said first arm whereby said second arm is adapted to contact a door casing member and to be fastened to the front of a stud.

7. A split jamb door assembly for mounting in a door opening which includes the features of claim 5 wherein said sizing clip has a single arm, and said body portion is positioned between the spaced jamb plate parts of the split hinge assembly.

8. A split jamb door assembly for mounting in a door opening which includes the features of claim 3 which further includes, in combination, a door casing having spaced side casings and a connecting top casing, and a side casing adjoining the stud plate part having a plurality of preformed mounting apertures which are in registry with the plurality of mounting apertures in said stud plate part when the door casing is mounted in position, whereby fasteners may move through the registered mounting apertures to secure the door, casing and jamb to the front of the wall stud.

9. A split jamb door assembly for mounting in a door opening which includes the features of claim 3 which further includes a plurality of sizing clips mounted to each of the spaced side jambs, each sizing clip having a body portion fastened to the outside of each of the spaced side jambs, and each sizing clip further having a deformable arm portion extending rearwardly of the interlocking side jamb, said arm portion having a mounting aperture so that a fastener can secure said arm portion to the side of the adjoining wall stud in a door opening when the arm is displaced to contact said wall stud.

10. A split jamb door assembly for mounting in a door opening which includes the features of claim 3 wherein at least one of said sizing clips includes a second arm at an end of the body portion opposite the end with the deformable arm, said second arm being normal to said body portion and having apertures, and mounting apertures in the door side casings to be registered with the mounting apertures in second arm so that said second arm and casing may be fastened to the front of a stud.

11. A method for mounting a prehung split jamb door in a doorway opening defined by spaced wall studs and a connecting top wall stud, wherein a door is hingably mounted to one interlocking side jamb by a split hinge assembly, wherein a plate part is fastened to the side jamb and another plate part extends outwardly of the side jamb and normally to the plate part mounted to said side jamb, said normally extending plate part lying against a side door casing so that mounting apertures in said normally extending plate part in the side door casing are in registry, and wherein each of the spaced side jambs have a plurality of mounted sizing clips with deformable portions extending rearwardly of the side jambs, a forward portion of each of said sizing clips having mounting apertures for alignment with mounting apertures in the door casing, which includes the steps of positioning the prehung door assembly in the doorway opening so that the spaced side jambs adjoin the spaced wall studs of the door opening, displacing the extending portions of the sizing clips towards the sides of the spaced wall studs, fastening the extending portions of the sizing clips to the sides of said spaced wall studs, mounting fasteners through the registered openings of the door casing and normally extending stud plate part and sizing clips and into the front of an adjoining wall stud, and mounting a complementary jamb member and casing from the opposite doorway opening towards the mounted prehung door assembly until the spaced and connecting top jamb parts meet with the mounted spaced and connecting top jamb parts of the prehung door assembly.

* * * * *